US006030194A

United States Patent [19]

Yakimow et al.

[11] Patent Number: 6,030,194

[45] Date of Patent: Feb. 29, 2000

[54] GEROTOR MOTOR AND IMPROVED VALVE DRIVE AND BRAKE ASSEMBLY THEREFOR

[75] Inventors: Scott E. Yakimow, Burnsville; Sohan L. Uppal, Bloomington, both of Minn.

[73] Assignee: Eaton Corporation, Cleveland, Ohio

[21] Appl. No.: 09/012,638

[22] Filed: Jan. 23, 1998

[51] Int. Cl.[7] ..... F01C 1/02

[52] U.S. Cl. ..... 418/61.3; 418/181; 418/133; 417/487

[58] Field of Search ..... 418/61.3, 181

[56] References Cited

U.S. PATENT DOCUMENTS

| | | | |
|---|---|---|---|
| 3,616,882 | 11/1971 | White . | |
| 3,628,896 | 12/1971 | Graffman | 417/487 |
| 3,801,239 | 4/1974 | Larson | 418/133 |
| 3,960,470 | 6/1976 | Kinder . | |
| 4,493,404 | 1/1985 | Wenker . | |
| 4,533,302 | 8/1985 | Begley . | |
| 4,613,292 | 9/1986 | Bernstrom et al. | 418/61.3 |
| 4,739,865 | 4/1988 | Yater et al. | 418/181 |
| 4,860,862 | 8/1989 | Yater et al. | 418/181 |
| 4,981,422 | 1/1991 | White . | |
| 4,981,423 | 1/1991 | Bissonnette . | |
| 5,100,310 | 3/1992 | Uppal . | |
| 5,114,324 | 5/1992 | Spindeldreher | 418/61.3 |
| 5,228,846 | 7/1993 | Lammers et al. . | |

FOREIGN PATENT DOCUMENTS

| | | | |
|---|---|---|---|
| 3125087 | 1/1983 | Germany | 418/61.3 |
| 241442 | 12/1986 | Germany | 418/61.3 |
| 1385965 | 3/1975 | United Kingdom | 418/61.3 |
| 2202906 | 10/1988 | United Kingdom | 418/61.3 |

*Primary Examiner*—Thomas Denion
*Assistant Examiner*—Thai-Ba Trieu
*Attorney, Agent, or Firm*—L. J. Kasper

[57] ABSTRACT

A gerotor motor (11) of the type having a spool valve (45) disposed opposite a main drive shaft (35). The motor also includes a set of brake discs (104) in engagement with an extension (45*e*) of the spool valve (45), and a set of brake discs (106) in engagement with internal splines (108) defined by an end cap (41). A piston (109) operable to engage the brake discs (104,106) is disposed in a chamber defined by the valve housing section (19), disposed adjacent the end cap (41). A valve drive shaft (57) having splines (53) engaging the main drive shaft (35) at its rotating end (33), also has splines (55) engaging the spool valve (45) to transmit the pure rotation of the drive shaft (35) to the spool valve (45). The result is a very compact valve drive and brake arrangement.

5 Claims, 4 Drawing Sheets

GEROTOR MOTOR AND IMPROVED VALVE DRIVE AND BRAKE ASSEMBLY THEREFOR

CROSS-REFERENCE TO RELATED APPLICATIONS

This application is related to co-pending U.S. application Ser. No. 09/012,511, filed Jan. 23, 1998 in the name of Sohan L. Uppal for a "GEROTOR MOTOR AND IMPROVED SPOOL VALVE THEREFOR".

STATEMENT REGARDING FEDERALLY SPONSORED RESEARCH OR DEVELOPMENT

Not applicable

MICROFICHE APPENDIX

Not applicable

BACKGROUND OF THE DISCLOSURE

The present invention relates to rotary fluid pressure devices used as hydraulic motors, and more particularly, to such motors in which the fluid displacement mechanism is a gerotor gear set, and the motor valving is of the spool valve type.

Rotary fluid pressure devices which include a gerotor gear set as the fluid displacement mechanism are typically used as low-speed, high-torque motors. Such gerotor motors have traditionally been classified as being either of the "spool valve" type, or of the "disk valve" type. In a spool valve gerotor motor, the valving is accomplished at a cylindrical interface between a spool valve and a spool bore defined by the surrounding housing. In a disk valve type, the valving is accomplished at a flat, transverse, planar interface of a disk valve and a stationary valve member.

Although the present invention may be included in a gerotor type device being utilized as a pump, it is especially adapted for use in a low-speed, high-torque gerotor motor, and will be described in connection therewith.

For many years, some of the gerotor motors made and sold commercially, both by the assignee of the present invention as well as by others, have had the motor valving disposed "rearwardly" of the gerotor gear set, and this has been true especially in regard to disk valve type motors. In more recent times, the assignee of the present invention has begun to commercialize motors having the spool valve disposed rearwardly (i.e., opposite the output end) of the gerotor gear set.

In many vehicle applications for low-speed, high-torque gerotor motors, it is desirable for the motor to have some sort of parking brake or parking lock, and in certain vehicle applications, it is desirable for the motor to have some sort of dynamic brake which can be applied while the vehicle is still moving, to bring the vehicle to a stop. It should be understood that, as used herein, the term "dynamic" brake means a brake having dynamic capabilities, i.e., one which can begin to be applied while the vehicle is still moving, but "dynamic" does not mean a true service-type brake which would be applied when the vehicle is traveling at its normal operating speed.

For many years, those skilled in the art have attempted to incorporate brake and lock devices into gerotor motors. Examples of such devices are illustrated and described in U.S. Pat. Nos. 3,616,882 and 4,981,423. In the device of U.S. Pat. No. 3,616,882, a braking element is disposed adjacent the forward end of the gerotor star, and is biased by fluid pressure into frictional engagement therewith. Such an arrangement involves a certain degree of unpredictability of performance, in view of variations in clearances, etc. Such an arrangement also requires a substantial redesign of the wear plate and forward bearing housing of the motor.

In the device of U.S. Pat. No. 4,981,423, there is a multi-disc brake assembly which is of the "spring-applied, pressure-release" type. The arrangement of U.S. Pat. No. 4,981,423 also requires almost total redesign of the forward bearing housing, and also results in a much larger bearing housing. In addition, the disc pack is in splined engagement with the output shaft and, therefore, must be able to brake or hold the full output torque of the motor, thus necessitating that the discs, the spring, and the apply/release piston all be relatively larger than is desirable. A related problem is that such a brake arrangement can reduce certain of the performance ratings of the motor, such as the side load capacity of the output shaft, which is generally considered very undesirable by the OEM customer.

BRIEF SUMMARY OF THE INVENTION

Accordingly, it is an object of the present invention to provide an improved gerotor motor which has an improved drive and brake arrangement which is extremely compact and efficient, and which does not require substantial redesign of the motor, in order to make the brake package available as an option.

The above and other objects of the invention are accomplished by the provision of a rotary fluid pressure device of the type including housing means having a fluid inlet port and a fluid outlet port and fluid energy translating displacement means associated with the housing means, and including an internally toothed member and an externally toothed member eccentrically disposed within the internally toothed member for relative oribital and rotational movement, to define expanding and contracting fluid volume chambers in response to the orbital and rotational movement. Valve means cooperates with the housing means to provide fluid communication between the inlet port and the expanding volume chambers and between the contracting volume chambers and the outlet port. A shaft means is provided for transmitting torque from the externally toothed member, the shaft means having an orbiting end in engagement with the externally toothed member, and a rotating end. The valve means comprises a generally cylindrical spool valve disposed in a spool bore defined by the housing means, and disposed on the side of the displacement mechanism opposite the shaft means.

The improved rotary fluid pressure device is characterized by the housing means defining a brake chamber, disposed on the side of the spool valve opposite the shaft means, and the spool valve includes an extension disposed axially within the brake chamber. A plurality of brake discs is disposed within the brake chamber, including at least one brake disc in fixed rotational engagement with the extension defined by the spool valve, and at least one brake disc fixed to be non-rotatable relative to the housing means. An axially movable piston is disposed axially adjacent the brake discs, and there is means biasing the piston and the brake discs into effective braking engagement.

DETAILED DESCRIPTION OF THE PREFERRED EMBODIMENT

Figure 1:
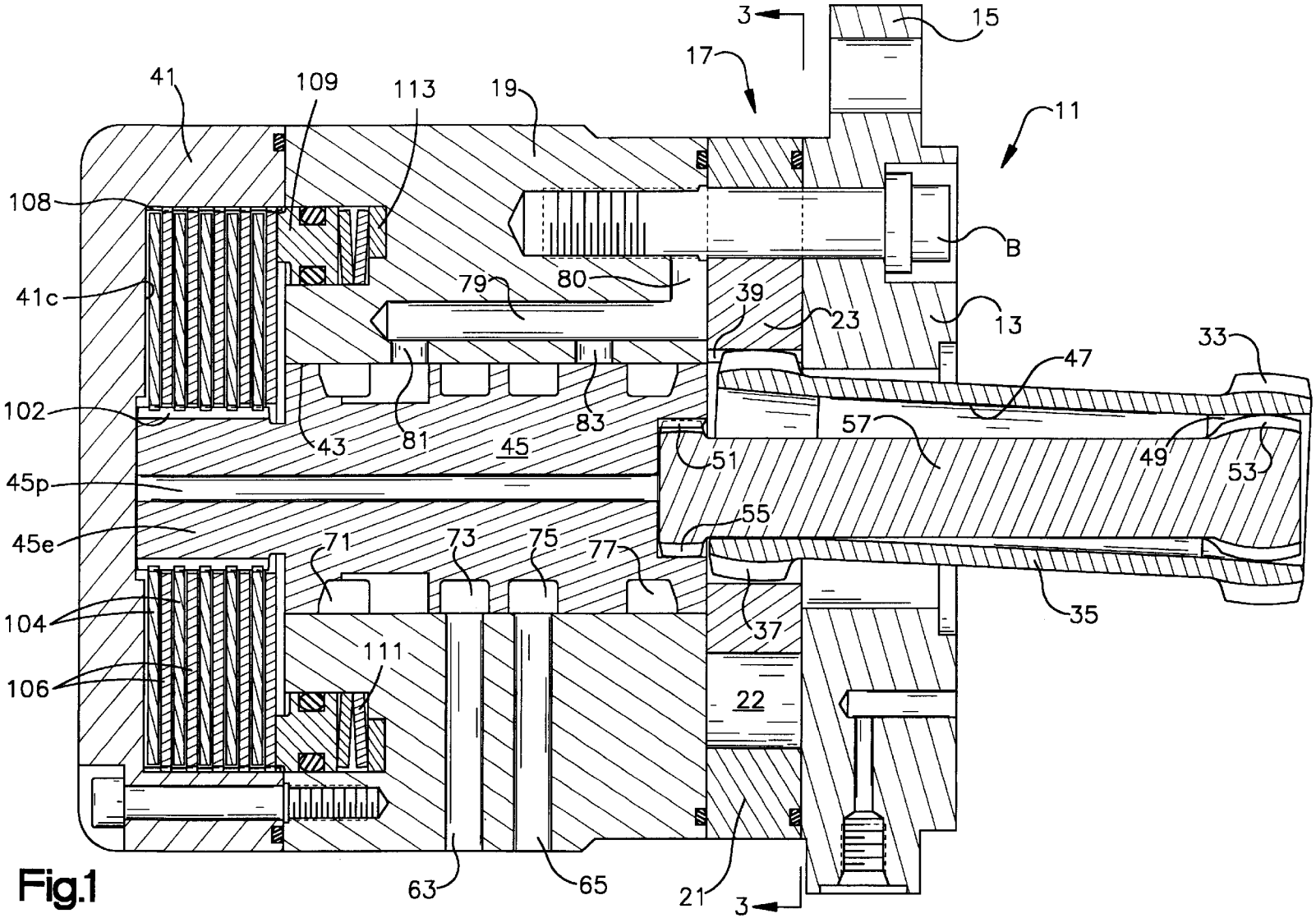
FIG. 1 is an axial cross-section of a low-speed, high-torque spool valve gerotor motor made in accordance with the present invention.
Figure 3:
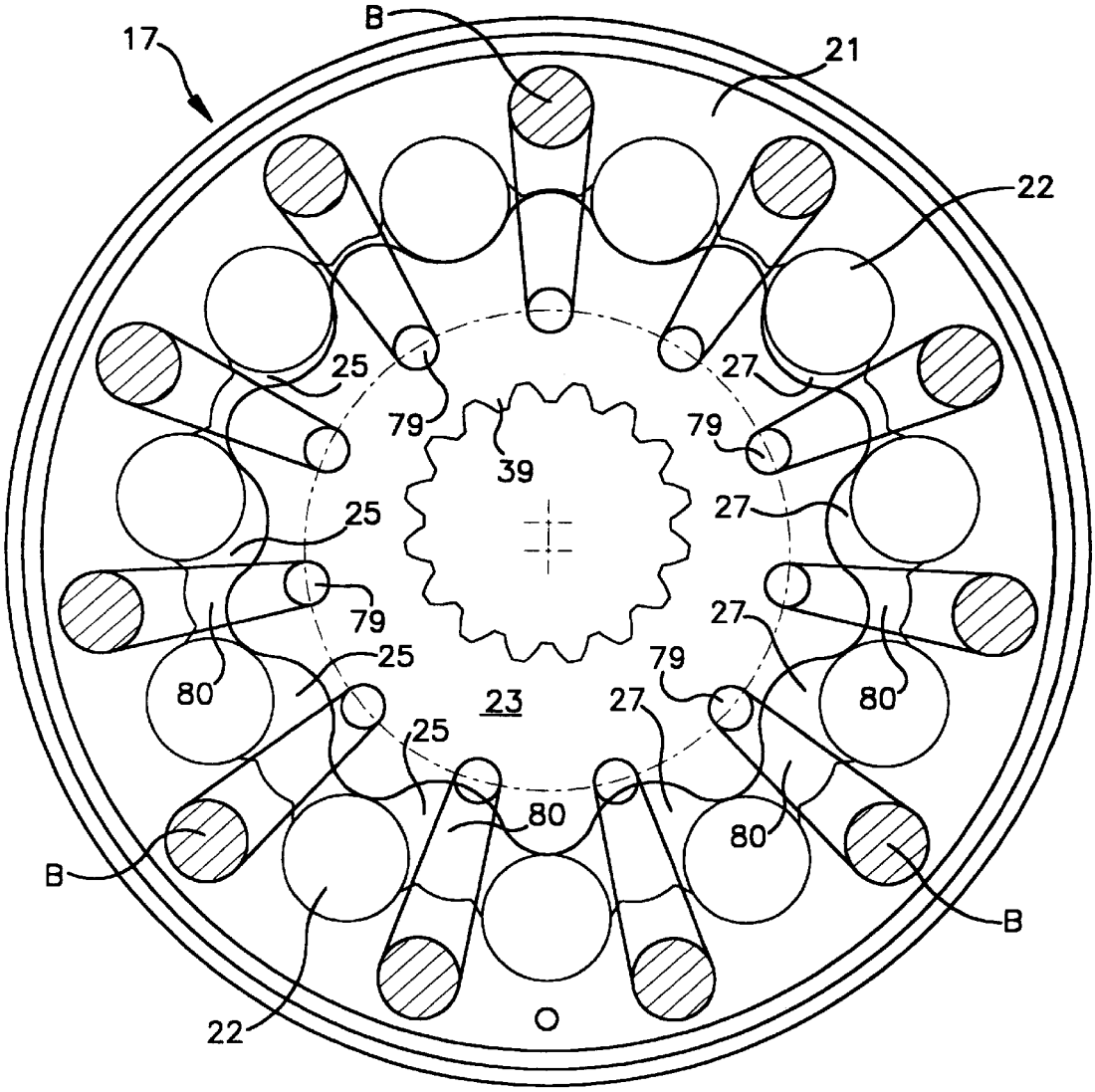
FIG. 3 is a transverse cross-section, taken on line 3—3 of FIG. 1, and including a representation of the openings in the end of the valve housing section.

Referring now to the drawings, which are not intended to limit the invention, FIG. 1 illustrates a low-speed, high-torque gerotor motor of the general type illustrated and described in U.S. Pat. No. 5,228,846, assigned to the assignee of the present invention and incorporated herein by reference. The motor, generally designated 11, comprises a plurality of sections secured together, such as by a plurality of bolts B, only one of which is shown in FIG. 1, but all of which are shown in FIG. 3 The motor 11 includes a forward end cap 13, including an enlarged flange portion 15. The motor 11 further includes a gerotor displacement mechanism, generally designated 17, and a valve housing section 19.

The gerotor displacement mechanism 17 is well known in the art, is shown and described in U.S. Pat. No. 4,533,302, assigned to the assignee of the present invention, and incorporated herein by reference, and therefore, it will be described only briefly herein. More specifically, the gerotor mechanism (gear set) 17 comprises an internally toothed ring member 21, having a plurality of internal teeth comprising rollers 22, and the gear set also includes an externally-toothed star member 23, eccentrically disposed within the ring member 21, and having one less tooth than the ring member 21. In the subject embodiment, and by way of example only, the star member 23 orbits and rotates relative to the stationary ring member 21, and this orbital and rotational movement defines a plurality of expanding fluid volume chambers 25, and a plurality of contracting fluid volume chambers 27 (see FIG. 3).

Referring again primarily to FIG. 1, the motor shown herein is of the type referred to as a "bearingless" motor, and therefore, does not include an output shaft as an integral part of the motor. Instead, the device which is to be driven by the motor 11 will include a set of internal, straight splines, and adapted for engagement therewith is a set of external, crowned splines 33, formed on a forward end of a main drive shaft 35, the drive shaft 35 also being referred to as a "dogbone" shaft. Disposed toward a rearward end of the drive shaft 35 is another set of external, crowned splines 37, in engagement with a set of internal, straight splines 39 formed about the inside diameter of the star member 23. In the subject embodiment, and as may best be seen in FIG. 3, the ring member 21 includes eleven internal teeth, and the star member 23 includes ten external teeth. Therefore, ten orbits of the star 23 results in one complete rotation thereof, and one complete rotation of the main drive shaft 35. It should be understood by those skilled in the art that, although the present invention is illustrated and described in terms of splined connections between the star 23, the dogbone 35, and the mating device, such is not an essential feature of the invention.

The valve housing section 19 has attached thereto an end cap 41, and the housing section 19 defines a spool bore 43. Disposed within the spool bore 43 is a valve spool 45 to be described in greater detail subsequently. The drive shaft 35 defines a bore 47, at the forward end of which is a set of straight internal splines 49. Disposed toward the forward end of the valve spool 45 is another set of straight internal splines 51, and in engagement with the sets of splines 49 and 51 are sets of external, slightly crowned splines 53 and 55, respectively, the splines 53 and 55 being formed at the forward and rearward ends, respectively, of a valve drive shaft 57.

Figure 4:
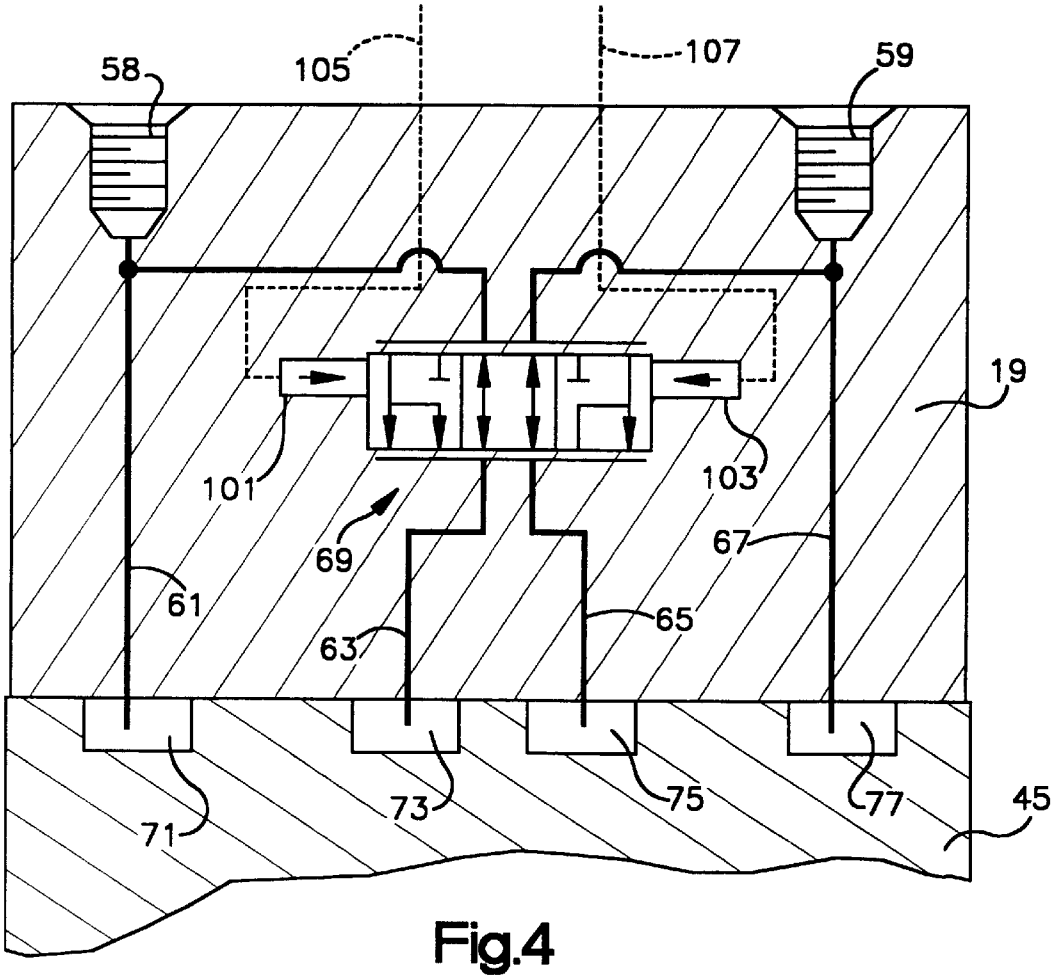
FIG. 4 is a somewhat schematic view, similar to FIG. 1, but on a larger scale, illustrating the various ports and passages of the motor shown in FIG. 1.

Referring now primarily to FIGS. 1 and 4, the valve housing section 19 defines a fluid inlet port 58 and a fluid outlet port 59. The housing section 19 also defines a plurality of fluid passages 61, 63, 65, and 67, which are shown only schematically (although passages 63 and 65 are also shown in FIG. 1), and each of which provides fluid communication from a control valve arrangement, generally designated 69, to the spool bore 43. For ease of illustration, the ports 58 and 59 and the control valve 69 are shown as being within the valve housing section 19, whereas, in actual production, there would typically be a separate manifold housing containing the control valve 69, with the manifold housing being bolted to the housing section 19.

The valve spool 45 defines a plurality of annular grooves 71, 73, 75, and 77, which are in continuous fluid communication with the fluid passages 61, 63, 65, and 67, respectively. Finally, the valve housing section 19 defines a plurality of axially-extending passages 79, each of which includes an enlarged opening 80 at its right end in FIG. 1 (the openings 80 being shown also in FIG. 3 for ease of illustration, and extending out toward the adjacent bolt B). Each of the enlarged openings 80 is in communication with the adjacent expanding or contracting volume chamber 25 or 27, respectively.

Each of the axially-extending passages 79 includes a first commutating opening 81 and a second commutating opening 83. As may best be seen in FIGS. 1 and 2, each of the first commutating openings 81 opens into the spool bore 43 between the annular grooves 71 and 73, whereas each of the second commutating openings 83 opens into the spool bore 43 between the annular grooves 75 and 77. The reason for the provision of two commutating openings communicating with each passage 79 will be described subsequently.

Figure 2:
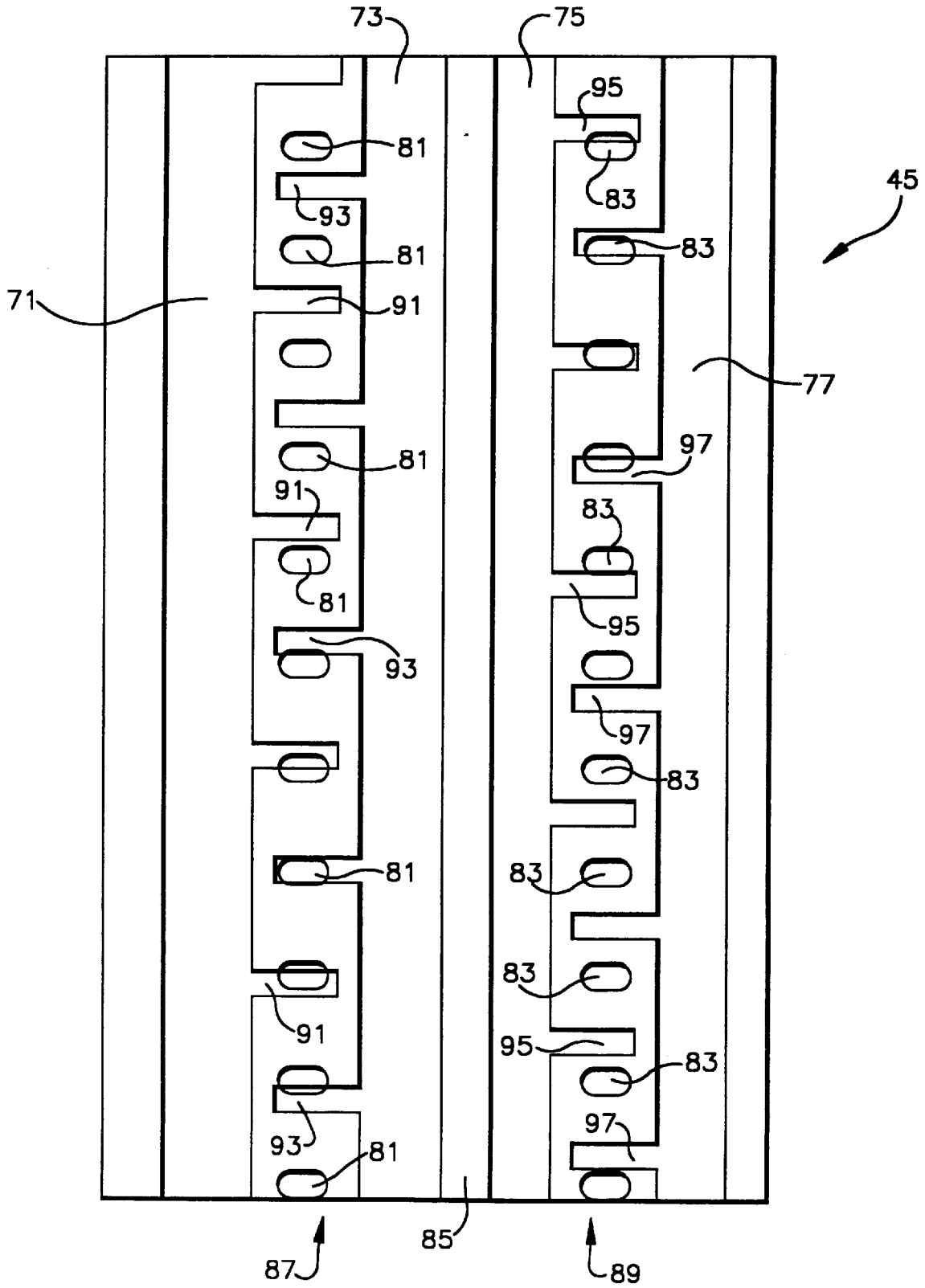
FIG. 2 is a somewhat schematic layout view of the spool valving used in the motor made in accordance with the present invention, but also showing commutating openings in the valve housing.

Referring now primarily to FIG. 2, additional structural details of the valve spool 45 may be seen. In approximately the center, axially, of the valve spool 45 is a sealing land 85, which is preferably sized and finished such that it cooperates with the adjacent surface of the spool bore 43 to define substantially a journal bearing fit, i.e., a radial clearance in the range of about 0.0002 to about 0.0005 inches, for reasons which will become apparent subsequently. With the motor 11 operating in the low speed, high torque mode (corresponding to the position of the control valve 69 shown in FIG. 5), the region to the left of the sealing land 85 comprises a high-pressure region, generally designated 87, and the region to the right of the sealing land 85 comprises a low pressure region, generally designated 89.

In communication with each of the annular grooves 71, 73, 75, and 77 is a plurality of axial passages (also referred to as "timing slots") 91, 93, 95, and 97, respectively. In the subject embodiment, because there are eleven internal teeth on the ring 21, there are eleven of the passages 79 and eleven of the first commutating openings 81, and eleven of the second commutating openings 83. Furthermore, because there are ten external teeth on the star 23 there are ten of the axial passages 91 and 93 (five of each), and ten of the axial passages 95 and 97 (five of each). The reason for having two commutating openings 81 and 83 associated with each of the axially-extending passages 79 will now be described.

In the normal high torque, low speed mode of operation, high pressure fluid fills the annular grooves 71 and 73, as well as the axial passages 91 and 93, while the annular grooves 75 and 77 and the axial passages 95 and 97 contain low pressure fluid. Therefore, referring still to FIG. 2, the axially-extending passage 79 associated with the "top" commutating openings 81 and 83 contains low pressure fluid (because the opening 83 overlaps the passage 95). As a result, the opening 81(at low pressure) is adjacent the axial passage 93 (at high pressure) and there is a short high pressure-low pressure interface therebetween. The situation is similar for the next two opening 81 and 83, just below the top two openings in FIG. 2, but in this case there is a larger sealing land between the opening 81 and the closest adjacent passage 91 or 93. It has been determined that the arrangement illustrated in FIG. 2 results in a substantial reduction in the total (or "effective") high pressure-low pressure interface, and therefore, a substantial reduction in the cross-port leakage, at least when the motor operates in the low-speed, high-torque mode.

Referring again primarily to FIG. 1, the improved drive and brake arrangement of the present invention will be described. As is well known by those skilled in the art, the end of the main drive shaft 35 merely rotates, while the end where the splines 37 are located both orbits and rotates, the orbital motion being at the full eccentricity of the gerotor star 23. Thus, the valve drive shaft 57 transmits the pure rotational motion of the end 33 of the drive shaft 35 to the spool valve 45, so that the axis of the valve drive shaft 57 remains substantially coincidental with the axis of rotation of the spool valve 45. It is believed that such an arrangement will substantially improve the life of the splines 51 and 53, which require less crown than if the shaft 57 were to orbit and rotate. As a result, the shaft 57 should be simpler and less expensive to manufacture.

In accordance with an important aspect of the present invention, the end cap 41 cooperates with the adjacent end of the valve housing section 19 to define a brake chamber 41*c*, and extending axially into the bake chamber 41*c*, the spool valve 45 includes an extension 45*e*. Preferably, the extension 45*e* is formed integrally with the valve spool 45, although such is not an essential feature of the present invention. The extension 45*e* defines a set of external splines 102 which, in the subject embodiment, are straight. Surrounding the splines 102 is a set of brake discs, including a plurality of internally-splined discs 104 which are in splined engagement with the splines 102. There is also a plurality of externally-splined discs 106 which are in splined engagement with a set of straight internal splines 108, defined by the end cap 41.

Disposed adjacent the brake (friction) discs 104 and 106, but disposed within a chamber defined by the valve housing section 19, there is a piston member 109, which is preferably sealed at both its outside and inside diameters relative to the housing 19. Although it is not an essential feature of the present invention to locate the chamber containing the piston 109 within the end of the valve housing section 19, such is preferred because the result is a much shorter and compact motor than would be the case if the piston 109 were disposed within the end cap 41.

The piston member 109 is biased toward a position engaging the clutch discs 104 and 106, by means of a Belleville washer 111, which is engaged adjacent its outside diameter by a washer 113. Thus, the brake arrangement shown in FIG. 1 is of the preferred spring-applied, pressure-released type. The spool valve 45 defines an axial central fluid passage 45*p*, which comprises at least part of the case drain region of the motor, and hereinafter, the reference numeral "45*p*" may also be used to refer to the case drain region. The left end (in FIG. 1) of the passage 45*p* is in fluid communication with the brake chamber 41*c*, such that the fluid pressure within the case drain 45*p* will also be present in the brake chamber 41*c*.

As was noted previously, the Belleville washer 111 normally biases the piston 109 toward a brake engaged position. In order to release the brake, pressurized fluid from the case drain region 45*p* is introduced into the brake chamber 41*c*, i.e., the chamber in which the discs 104 and 106 are disposed. By way of example only, the pressure from the case drain 45*p* is typically about two-thirds of the difference between the inlet port 58 pressure and the outlet port 59 pressure. This case drain pressure in the brake chamber 41*c* acts on the piston 109 and overcomes the biasing force of the Belleville washer 111, moving the piston to the right in FIG. 1 until the discs 104 and 106 are effectively "disengaged", and exert no substantial braking torque on the extension 45*e*. As is well known to those skilled in the art of brake and clutch devices, the discs 104 and 106 may still be in contact with each other in the disengaged mode. "Disengaged" merely means that there is not sufficient engagement of the discs 104 and 106 to transmit braking torque.

Locating the brake discs 104 and 106 at a location within the end cap 41 results in a very compact packaging arrangement for both the valve drive and the brake. It is possible, and fairly convenient to provide the brake package of the present invention as an option and, although a different spool valve (i.e., one including the extension 45*e*) and end cap are required, there is no true "redesign" of the motor involved. The practical result is that offering the brake package as an option can be done much less expensively than with the typical prior art brake design.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A rotary fluid pressure device of the type including housing means having a fluid inlet port and a fluid outlet port; fluid energy translating displacement means associated with said housing means, and including an internally-toothed member, and an externally-toothed member eccentrically disposed within said internally-toothed member for relative orbital and rotational movement, to define expanding and contracting fluid volume chambers in response to said orbital and rotational movement; valve means cooperating with said housing means to provide fluid communication between said fluid inlet port and said expanding volume chambers, and between said contracting volume chambers and said outlet port; shaft means for transmitting torque from said externally-toothed member, said shaft means having an orbiting end in engagement with said externally-toothed member, and a rotating end; said valve means comprising a generally cylindrical spool valve disposed in a spool bore defined by said housing means, and disposed on the side of said displacement mechanism opposite said shaft means; characterized by:

(a) said housing means defining a brake chamber, disposed on the side of said spool valve opposite said shaft means, and said spool valve including an extension disposed axially within said brake chamber;

(b) a plurality of brake discs disposed within said brake chamber, including at least one brake disc in fixed rotational engagement with said extension defined by said spool valve, and at least one brake disc fixed to be non-rotatable relative to said housing means; and (c) an axially movable piston disposed axially adjacent said brake discs, and means biasing said piston and said brake discs into effective braking engagement.

2. A rotary fluid pressure device as claimed in claim 1, characterized by said shaft means including means operable to transmit said rotational movement of said shaft means into rotational movement of said spool valve.

3. A rotary fluid pressure device as claimed in claim 2, characterized by said means to transmit said rotational movement comprises a valve drive shaft having a forward end in splined engagement with said shaft means at a rotating end, and a rearward end in splined engagement with said valve spool.

4. A rotary fluid pressure device as claimed in claim 1, characterized by said axially movable piston adjacent said brake disc being disposed within a chamber defined by a valve housing section disposed axially adjacent an end cap defining said brake chamber, said piston being biased by said biasing means toward said end cap.

5. A rotary fluid pressure device as claimed in claim 4, characterized by said brake chamber being in fluid communication with a case drain region, the fluid pressure in said case drain region being operable to bias said piston toward a position in which said brake discs are out of effective braking engagement.

* * * * *